US011879636B2

(12) United States Patent
Newell et al.

(10) Patent No.: US 11,879,636 B2
(45) Date of Patent: Jan. 23, 2024

(54) BURNER NOZZLES FOR WELL TEST BURNER SYSTEMS

(71) Applicant: Halliburton Energy Services, Inc., Houston, TN (US)

(72) Inventors: Elling James Newell, Argyle, TX (US); Mark Henry Strumpell, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 558 days.

(21) Appl. No.: 17/147,871

(22) Filed: Jan. 13, 2021

(65) Prior Publication Data

US 2021/0164648 A1 Jun. 3, 2021

Related U.S. Application Data

(62) Division of application No. 15/565,675, filed as application No. PCT/US2015/030467 on May 13, 2015, now Pat. No. 10,928,060.

(51) Int. Cl.

| | |
|---|---|
| ***F23D 11/38*** | (2006.01) |
| ***F23D 11/00*** | (2006.01) |
| ***F23R 3/28*** | (2006.01) |

(52) U.S. Cl.

CPC ..... *F23D 11/38* (2013.01); *F23D 11/005* (2013.01); *F23R 3/28* (2013.01); *F23R 2900/03044* (2013.01)

(58) Field of Classification Search

CPC ..... F23D 11/005; F23R 2900/03044; E21B 36/02

(Continued)

(56) References Cited

U.S. PATENT DOCUMENTS 3,894,831 A 7/1975 Glotin et al.
3,980,416 A 9/1976 Goncalves et al.

(Continued)

FOREIGN PATENT DOCUMENTS

WO 2014120230 A1 8/2014
WO 2014120231 A1 8/2014

(Continued)

OTHER PUBLICATIONS

International Search Report and Written Opinion for PCT/US2015/030467 dated Jan. 27, 2016.

(Continued)

*Primary Examiner* — Ko-Wei Lin

(74) *Attorney, Agent, or Firm* — DeLizio, Peacock, Lewin & Guerra, LLP

(57) ABSTRACT

A burner nozzle assembly includes a plurality of burner nozzles. Each burner nozzle includes an outer housing and a nozzle receivable within the outer housing. An air inlet conveys air into a first burner nozzle of the plurality of burner nozzles and a well product inlet conveys a well product into the first burner nozzle. An air transfer conduit interposes and fluidly couples the outer housing of adjacent burner nozzles and transfers the air from the first burner nozzle to subsequent burner nozzles of the plurality of burner nozzles, and a well product transfer conduit interposes and fluidly couples the outer housing of adjacent burner nozzles and transfers the well product from the first burner nozzle to subsequent burner nozzles.

20 Claims, 7 Drawing Sheets

(58) Field of Classification Search
USPC ..... 431/23, 12, 354
See application file for complete search history.

(56) References Cited

U.S. PATENT DOCUMENTS

| | | | | |
|---|---|---|---|---|
| 4,013,396 | A | 3/1977 | Tenney | |
| 4,655,706 | A | 4/1987 | Bayh, III | |
| 5,044,558 | A | 9/1991 | Young et al. | |
| 5,058,808 | A | 10/1991 | Young | |
| 5,067,657 | A | 11/1991 | Young et al. | |
| 5,096,124 | A | 3/1992 | Young | |
| 5,636,980 | A * | 6/1997 | Young | F23D 11/102 431/278 |
| 5,918,670 | A | 7/1999 | Coutts et al. | |
| 5,993,196 | A * | 11/1999 | Young | F23D 11/102 431/278 |
| 6,036,479 | A | 3/2000 | Dubach et al. | |
| 6,637,674 | B1 | 10/2003 | Mistler | |
| 7,566,217 | B2 | 7/2009 | Mörsner | |
| 9,366,434 | B2 | 6/2016 | Cody et al. | |
| 9,857,078 | B2 | 1/2018 | Cody et al. | |
| 10,001,275 | B2 | 6/2018 | Cody | |
| 2007/0248920 | A1 | 10/2007 | Morsner | |
| 2009/0011378 | A1 | 1/2009 | Caminada | |
| 2010/0143852 | A1* | 6/2010 | Waltz | F23L 9/02 110/297 |
| 2014/0190168 | A1 | 7/2014 | Shershnyov et al. | |
| 2015/0204542 | A1 | 7/2015 | Tolstoukhov | |
| 2015/0345783 | A1 | 12/2015 | Cody et al. | |
| 2015/0354814 | A1* | 12/2015 | Cody | F23C 5/06 431/2 |
| 2015/0354816 | A1* | 12/2015 | Cody | F23D 11/46 431/89 |
| 2016/0290291 | A1* | 10/2016 | Prociw | F02M 31/20 |
| 2018/0073729 | A1 | 3/2018 | Newell et al. | |

FOREIGN PATENT DOCUMENTS

| | | | |
|---|---|---|---|
| WO | 2014120235 | A1 | 8/2014 |
| WO | 2014120237 | A1 | 8/2014 |

OTHER PUBLICATIONS

"Environmentally Distinctive Burner System", [online] retrieved on Nov. 12, 2020 from <https://www.halliburton.com/content/dam/ps/public/ts/contents/Data_Sheets/web/H/Environmentally-Distinctive-Burner-H011041.pdf>, Apr. 2015, 3 pages.

* cited by examiner

BURNER NOZZLES FOR WELL TEST BURNER SYSTEMS

BACKGROUND

Prior to connecting a well to a production pipeline, a well test is performed where the well is produced and the production fluids (e.g., crude oil and gas) are evaluated. Following the well test, the production fluids collected from the well must be disposed of. In certain instances, the product is separated and a portion of the product (e.g., substantially crude oil) may be disposed of by burning using a well test burner system. On offshore drilling platforms, for example, well test burner systems are often mounted at the end of a boom that extends outward from the side of the platform. As the well is tested, the produced crude is piped out the boom to the well test burner system and burned. Well test burner systems are also often used in conjunction with land-based wells.

Traditionally, well test burner systems include several burner nozzles that allow the well test burner system to operate over a wide range of flow rates. Burner nozzles are often selectively capped to reduce the flow rate through the well test burner system when desired. The un-capped burner nozzles have large amounts of air and oil flowing through them, which serves to remove thermal energy and thereby keeps them cool. The capped nozzles, however, are exposed to radiant heat emitted from the flame discharged from the un-capped nozzles. Such radiant heat can sometimes result in seal failure for the un-capped nozzles.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DESCRIPTION

The present disclosure is related to well operations in the oil and gas industry and, more particularly, to well test burner systems and improvements to burner nozzles used in well test burner systems.

The embodiments described herein provide an improved burner nozzle that includes an outer housing, and a nozzle and a piston receivable within the outer housing. The piston is movable between an open position, where air and a well product are able to enter an atomizing chamber defined in the nozzle to generate an air/well product mixture, and a closed position, where the piston moves to stop a flow of the well product. In the closed position, a metered amount of air may be able to flow through one or more leak paths defined between a leading edge of the piston and an adjacent closure surface provided by the nozzle and into the atomizing chamber. As the air flows through the leak path, thermal energy may be drawn away from the burner nozzle, thereby mitigating any adverse effects of radiant thermal energy emitted by adjacent burner nozzles. Additionally, as the air flows through the nozzle and the flow of the well product is stopped, all residual well product is atomized and burned, thereby removing the potential for drips. As will be appreciated, this may prove advantageous in improving safety, operational costs, and the environmental impact of burner nozzles used in well test burner systems.

The embodiments described herein also include a burner nozzle assembly that includes a plurality of burner nozzles, where each burner nozzle includes an outer housing and a nozzle received within an interior of the outer housing. An air inlet conveys air into a first burner nozzle of the plurality of burner nozzles, and a well product inlet conveys a well product into the first burner nozzle of the plurality of burner nozzles. An air transfer conduit interposes and fluidly couples the outer housing of adjacent burner nozzles such that the air is able to be transferred from the first burner nozzle to all subsequent burner nozzles. Similarly, a well product transfer conduit interposes and fluidly couples the outer housing of adjacent burner nozzles such that the well product is able to be transferred from the first burner nozzle to all subsequent burner nozzles. As the air and/or well product is conveyed to subsequent burner nozzles, thermal energy may be drawn away, and thereby serving to cool the preceding burner nozzle(s).

Figure 1:
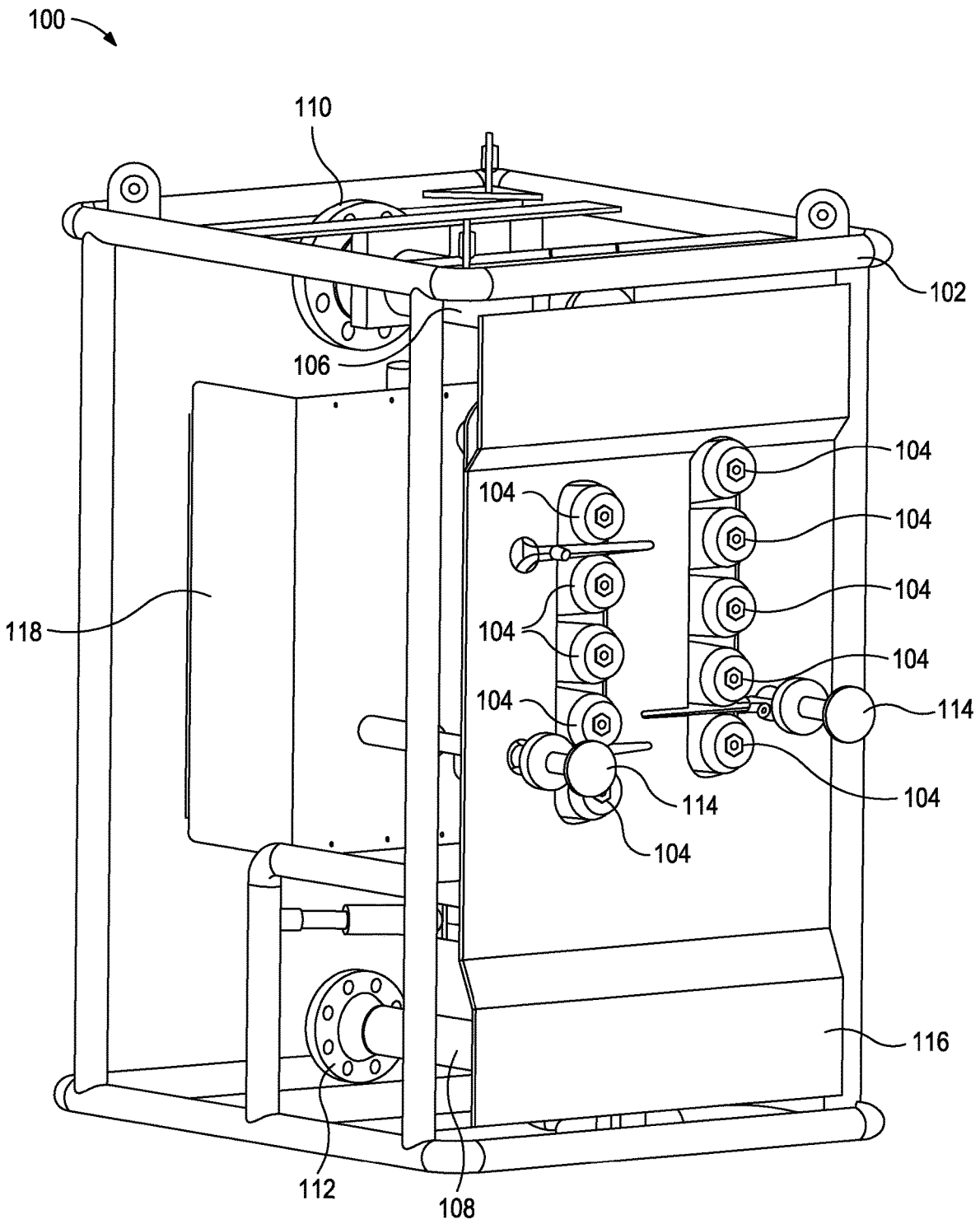
FIG. 1 is a perspective view of an example well test burner system that may employ the principles of the present disclosure.

Referring to FIG. 1, illustrated is a perspective view of an example well test burner system 100 that may employ the principles of the present disclosure, according to one or more embodiments. The well test burner system 100 (hereafter the "burner system 100") may be configured to burn production fluids or a "well product" (e.g., crude oil and hydrocarbon gas) produced from a well, for example, during its test phase. In certain applications, the burner system 100 may be employed on an offshore drilling platform and mounted to a boom that extends outward from the platform. In other applications, the burner system 100 could be mounted to a skid our similar mounting structure for use with a land-based well. It will be appreciated that the depicted burner system 100 is but one example of well test burner systems that may suitably employ the principles of the present disclosure. Accordingly, the burner system 100 is depicted and described herein for illustrative purposes only and should not be considered as limiting to the present disclosure.

As illustrated, the burner system 100 includes a frame 102 that carries and otherwise supports the component parts of the burner system 100 and is adapted to be mounted to a boom or a skid. The frame 102 is depicted as comprising generally tubular support components and defines a substantially cubic-rectangular shape, but could alternatively assume other configurations, without departing from the scope of the disclosure. The frame 102 carries one or more burner nozzles 104 adapted to receive air and a well product, such as crude oil. The burner nozzles 104 combine the air and the well product in a specified ratio and expel an air/well product mixture for burning. It should be noted that while ten burner nozzles 104 are depicted in FIG. 1, more or less than ten burner nozzles 104 may be employed in burner system 100, without departing from the scope of the disclosure. Moreover, the burner nozzles 104 are depicted as being arranged vertically in two parallel columns. In other applications, however, the burner nozzles 104 can be arranged differently, for example, with fewer or more columns or in a different shape, such as in a circle, offset triplets, or in another different configuration.

The burner nozzles 104 are coupled to and receive air via an air inlet pipe 106. They are also coupled to and receive the well product to be disposed of via a product inlet pipe 108. In certain instances, one or both of the air and product inlet pipes 106, 108 comprise a rigid pipe. In other applications, however, one or both of the air and product inlet pipes 106, 108 may comprise a flexible hose or conduit. As illustrated, each inlet pipe 106, 108 is provided with a flange 110, 112, respectively. The first flange 110 allows the air inlet pipe 106 to be coupled to a source of air, such as an air compressor, and the second flange 112 allows the product inlet pipe 108 to be coupled to a line or conduit that provides the well product to the burner system 100 to be disposed of (i.e., burned).

The frame 102 also carries one or more pilot burners 114 that are coupled to and receive a supply of pilot gas. Two pilot burners 114 are shown flanking the two vertical columns of the burner nozzles 104, and each is positioned between the first two burner nozzles 104 (i.e., the two lowermost) in each column. The pilot burners 114 burn the pilot gas to maintain a pilot flame used to light the air/product mixture expelled from the burner nozzles 104 adjacent the pilot burners 114. The remaining burner nozzles 104 are arranged so that they expel air/product mixture in an overlapping fashion, so that the burner nozzles 104 lit by the pilot burners 114 light adjacent burner nozzles 104, and those burner nozzles 104, in turn, light adjacent burner nozzles 104, and so on so that the air/product mixture discharged from all burner nozzles 104 is ignited.

The frame 102 carries one or more heat shields to reduce transmission of heat from the burning well product to the various components of the burner system 100, as well as to the boom and other components of the associated platform. For example, the frame 102 can include a primary heat shield 116 that spans substantially the entire front surface of the frame 102. The frame 102 can also include one or more secondary heat shields to further protect other components of the burner system 100. For example, a secondary heat shield 118 is shown surrounding a control box (hidden) of the burner system 100. As will be appreciated, fewer or more heat shields 116, 118 can be provided, without departing from the scope of the disclosure.

Figure 2:
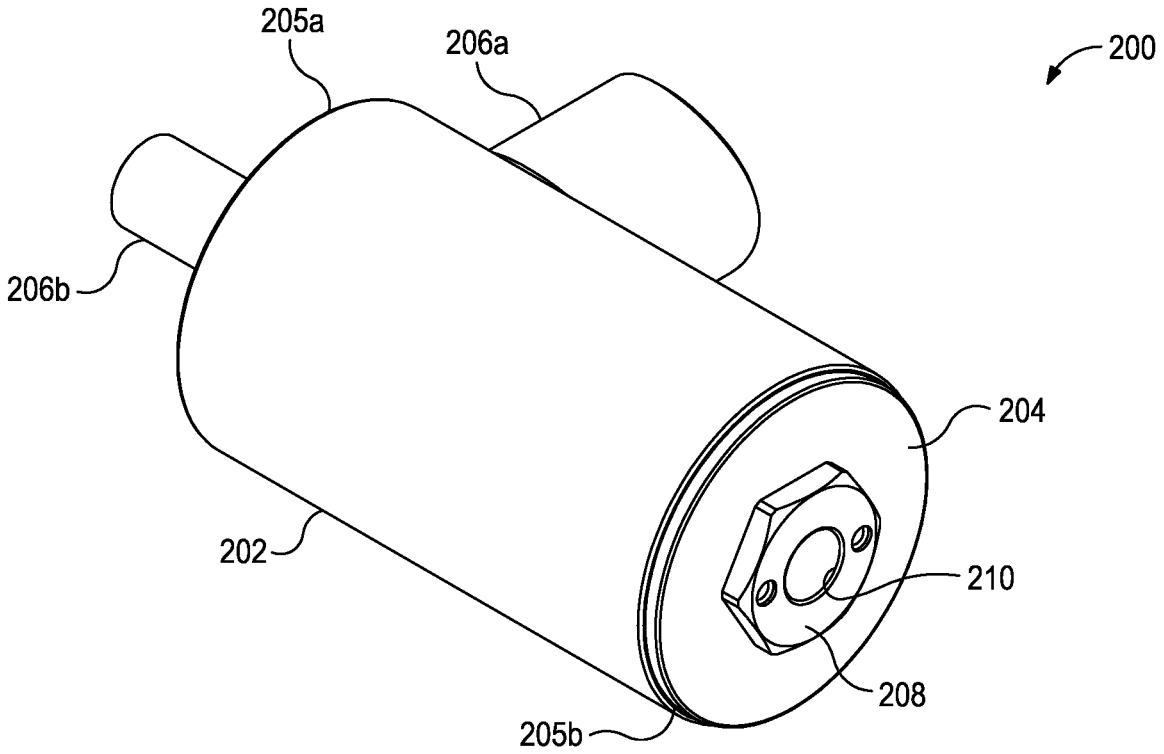
FIG. 2 is an isometric view of an exemplary burner nozzle.

Referring now to FIG. 2, illustrated is an isometric view of an exemplary burner nozzle 200, according to one or more embodiments of the present disclosure. The burner nozzle 200 may be the same as or similar to any of the burner nozzles 104 of FIG. 1 and, therefore, may be used in the burner system 100 to burn an air/well product mixture. As illustrated, the burner nozzle 200 may include an outer housing 202 and a nozzle 204 received and otherwise secured within the interior of the outer housing 202.

The outer housing 202 may exhibit a generally cylindrical shape and provide a first or top end 205*a* and a second or bottom end 205*b*. An air inlet 206*a* may extend from a side of the outer housing 202 at a location between the top and bottom ends 205*a,b*, and may be configured to convey a flow of air into the burner nozzle 200. A well product inlet 206*b* may extend from the top end 205*a* and may be configured to convey a flow of a well product into the burner nozzle 200. Accordingly, the air inlet 206*a* may be fluidly coupled to the air inlet pipe 106 (FIG. 1) and the well product inlet 206*b* may be fluidly coupled to the well product inlet pipe 108 (FIG. 1).

The air and well product inlets 206*a,b* may each comprise a pipe or tubing conduit either coupled to the outer housing 202 at their respective locations or forming an integral part or extension of the outer housing 202. In some embodiments, one or both of the air and well product inlets 206*a,b* may extend into the interior of the outer housing 202. In other embodiments, however, one or both of the air and well product inlets 206*a,b* may be directly or indirectly coupled to the outer surface of the outer housing 202 at respective locations.

The nozzle 204 may be received within the interior of the outer housing 202 and secured thereto at the bottom end 205*b*. In some embodiments, for example, the nozzle 204 may be threaded into the outer housing 202. To help facilitate this threaded engagement, the nozzle 204 may provide a hex nut feature that may allow torque to be transferred to the body of the nozzle 204 to allow the nozzle 204 to be threaded into the outer housing 202. In other embodiments, however, the nozzle 204 may alternatively be secured within the outer housing 202 by other means including, but not limited to, one or more mechanical fasteners (e.g., screws, bolts, snap rings, pins, etc.), a press-fit, a shrink-fit, welding, brazing, an adhesive, and any combination thereof. As depicted, the nozzle 204 may provide and otherwise define a nozzle outlet 210. In operation, as discussed below, the burner nozzle 200 may discharge an air/well product mixture via the nozzle outlet 210 that is ignited and burned.

Figure 3A:
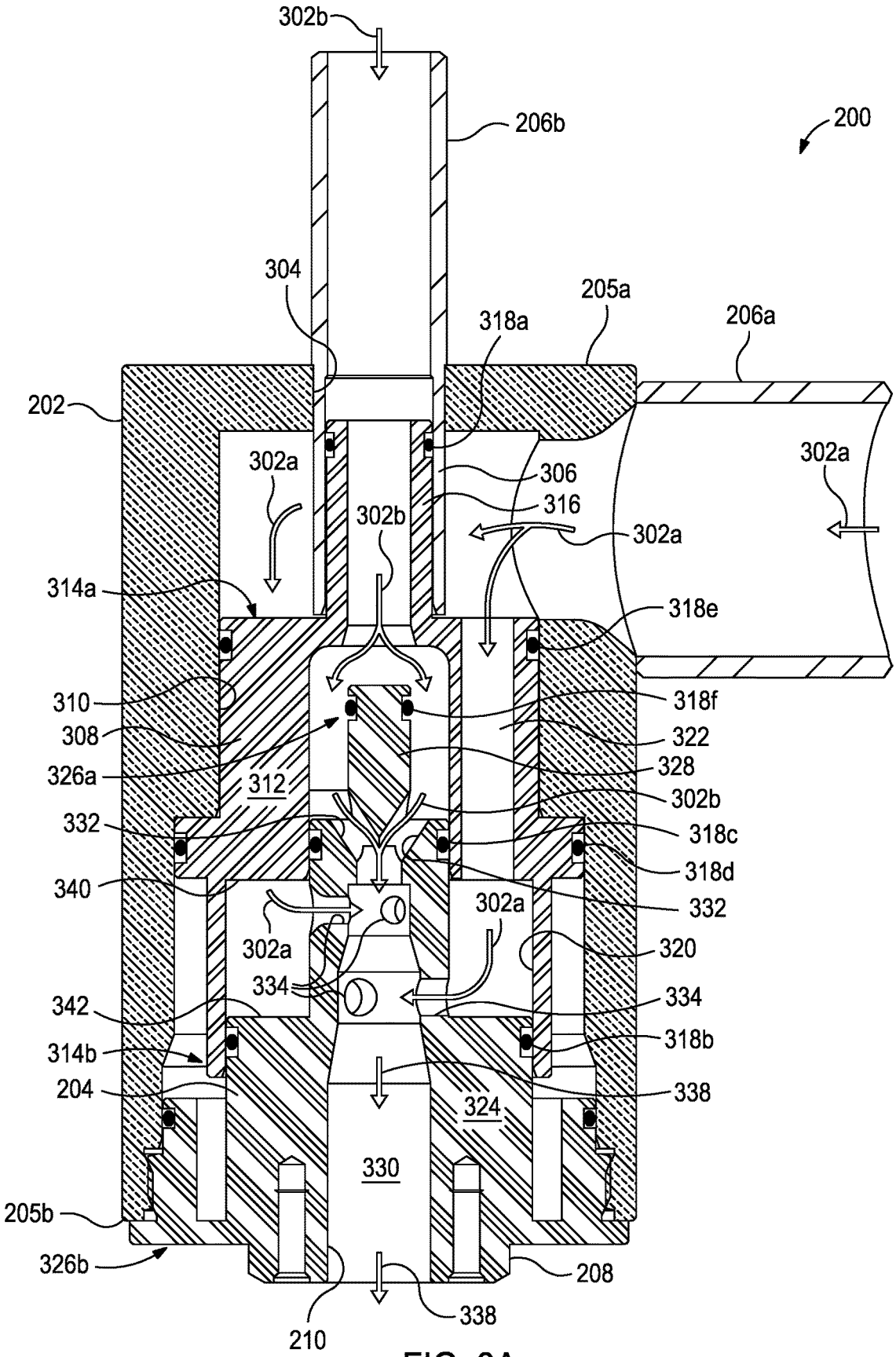
FIGS. 3A and 3B are cross-sectional side views of the burner nozzle of FIG. 2.
Figure 3B:
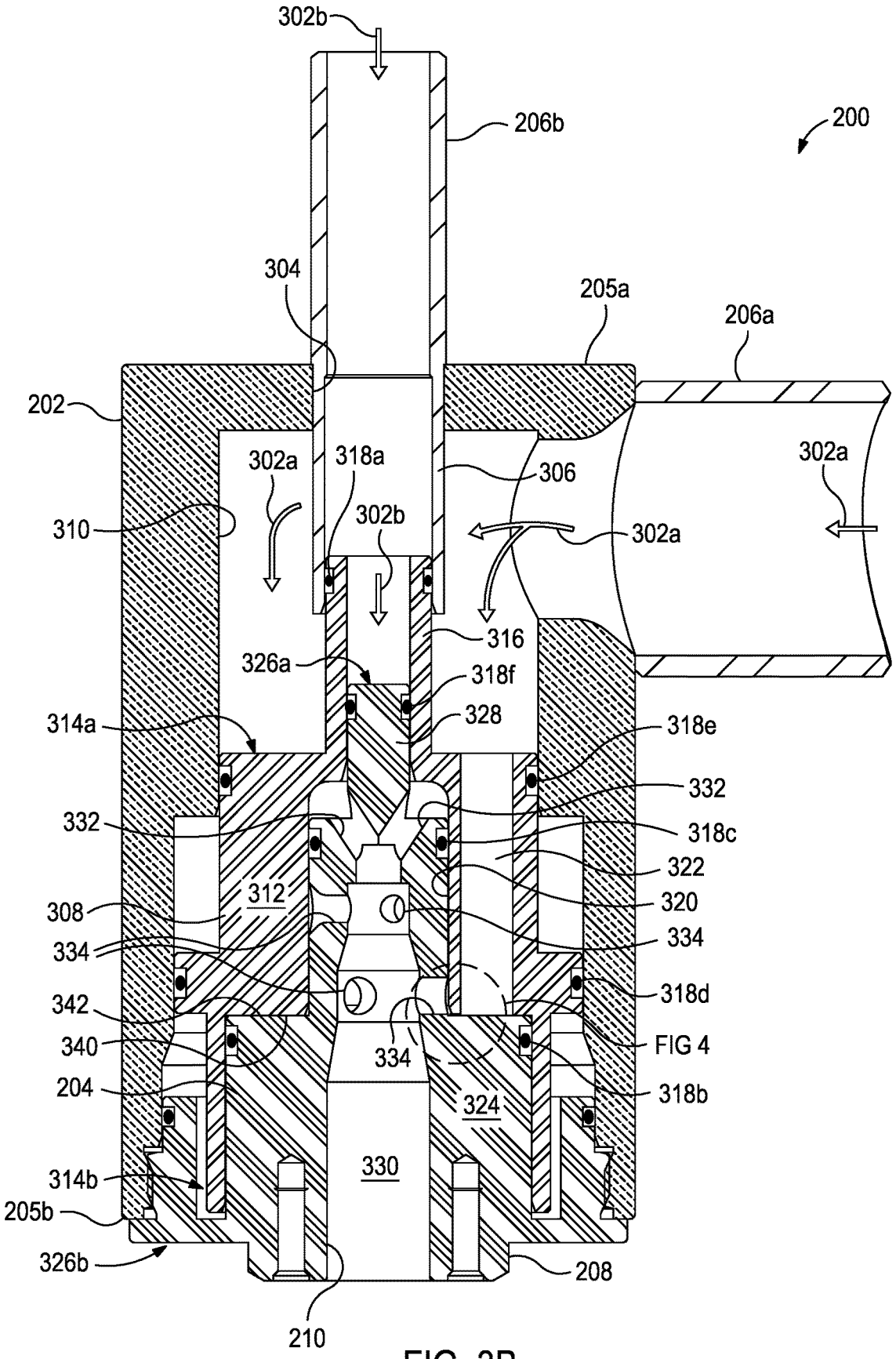

Referring to FIGS. 3A and 3B, with continued reference to FIG. 2, illustrated are cross-sectional side views of the burner nozzle 200. Similar numerals used in FIGS. 3A-3B and FIG. 2 correspond to similar components that may not be described again in detail. As illustrated, the air inlet 206*a* is coupled to and extends from the side of the outer housing 202 at a point between the top and bottom ends 205*a,b*. In other embodiments, however, the air inlet 206*a* may alternatively extend within the outer housing 202 and/or extend from the outer housing 202 at a different location, such as from the top end 205*a*. A flow of air may be conveyed and otherwise circulate into the burner nozzle 200 via the air inlet 206*a*, as indicated by the arrows 302*a*.

The well product inlet 206*b* is depicted as extending through an aperture 304 defined in the top end 205*a* of the outer housing 202. More specifically, the well product inlet 206*b* may include a product inlet conduit 306 that extends from or otherwise forms an integral part of the well product inlet 206*b* and extends into the interior of the outer housing 202 via the aperture 304. A flow of well product may circulate into the burner nozzle 200 via the well product inlet 206*a* and the product inlet conduit 306, as indicated by the arrows 302*b*.

The nozzle 204 is depicted as extended into the outer housing 202, as generally described above. The burner nozzle 200 may further include a piston 308 positioned within the outer housing 202 and at least partially receiving the nozzle 204. As illustrated, the outer housing 202 may define and otherwise provide an internal cavity 310 configured to receive and seat the piston 308. The piston 308 may comprise a substantially cylindrical structure that includes a piston body 312 having a first end 314*a* and a second end 314*b*. A stem conduit 316 extends from the first end 314*a* and is configured to be received within the well product inlet 206*b* (i.e., the product inlet conduit 306), and thereby provide a continuous flow path for the well product 302*b* to proceed through the burner nozzle 200. One or more seals 318*a* (e.g., O-rings or the like) may be positioned at an interface between the stem conduit 316 and an inner wall of the well product inlet 206*b* (i.e., the product inlet conduit 306) to prevent migration of the well product 302*b* past that interface.

A piston chamber 320 may be defined within the piston body 312 at or near the second end 314*b*. The piston chamber 320 may be configured to receive at least a portion of the nozzle 204 therein. One or more seals 318*b* and 318*c* (e.g., O-rings or the like) may be positioned at corresponding interfaces between the piston 308 and the nozzle 204 within the piston chamber 320. The first seal 318*b* may be configured to prevent the migration of air 302*a* past the location of the particular interface within the piston chamber 320, while the second seal 318*c* may be configured to prevent the migration of the well product 302*b* past the location of the particular interface within the piston chamber 320.

The piston body 312 may further define and otherwise provide one or more axial flow ports 322 (one shown) that extend axially between the first end 314*a* of the piston body 312 and the piston chamber 320. In some embodiments, the piston 308 may provide three axial flow ports 322 that are angularly offset from each other at 120° intervals. In such embodiments, the flow ports 322 may each exhibit a generally arcuate cross-sectional shape extending about a circumference of the piston chamber 320. In other embodiments, however, more or less than three axial flow ports 322 may be provided, without departing from the scope of the disclosure. Each axial flow port 322 may be fluidly coupled to or otherwise in fluid communication with the air inlet 206*a* such that air 302*a* conveyed to the burner nozzle 200 via the air inlet 206*a* may be conveyed to the piston chamber 320 via the axial flow ports 322.

The nozzle 204 may include a nozzle body 324 that has a first end 326*a* and a second end 326*b*. An atomizer 328 may be provided and otherwise defined at the first end 326*a*, and the nozzle outlet 210 may be defined at the second end 326*b*. An atomizing chamber 330 may be defined within the nozzle body 324 and extend from the nozzle outlet 210 toward the first end 326*a* of the nozzle body 324.

One or more atomizing conduits 332 may be defined in the nozzle body 324 at the atomizer 328 to provide fluid communication between the atomizing chamber 330 and the well product inlet 206*b*. Moreover, one or more radially-extending apertures 334 may be defined in the nozzle body 324 at an intermediate location between the first and second ends 326*a,b* of the nozzle body 324 to provide fluid communication between the atomizing chamber 330 and the piston chamber 320 and, therefore, between the atomizing chamber 330 and the air inlet 206*a*. Accordingly, air 302*a* may be conveyed into the atomizing chamber 330 from the piston chamber 320 via the apertures 334, and the well product 302*b* may be conveyed into the atomizing chamber 330 from the well product inlet 206*b* via the atomizing conduits 332.

The atomizing conduits 332 and the apertures 334 may each exhibit a predetermined flow area configured to meter a known amount of well product 302*b* and air 302*a*, respectively, into the atomizing chamber 330 to be mixed and otherwise combined. As a result, a specified or predetermined ratio of air 302*a* and well product 302*b* may be supplied to the atomizing chamber 330 and combined to create an air/well product mixture 338 having a known ratio. As will be appreciated, the converging atomizing conduits 332 may be configured to promote turbulence within the atomizing chamber 330, which facilitates the necessary mixing to generate the air/well product mixture 338. The resulting air/well product mixture 338 may then be discharged from the atomizing chamber 330 via the nozzle outlet 210.

The piston 308 may be axially movable within the outer housing 202 (i.e., the internal cavity 310) between an open position, as shown in FIG. 3A, and a closed position, as shown in FIG. 3B. In the open position, the air 302*a* and the well product 302*b* are each able to enter the piston chamber 330 unobstructed and the air/well product mixture 338 may subsequently be discharged via the nozzle outlet 210 for burning. In the closed position, however, the piston 308 is moved downward (i.e., toward the bottom end 205*b* of the outer housing 202) with respect to the nozzle 204, and thereby stopping the flow of the well product 302*b* and substantially stopping the flow of the air 302*a* into the atomizing chamber 330. Accordingly, when the piston 308 is in the closed position, the burner nozzle 200 may be considered "capped" or otherwise non-operating.

The piston 308 may be moved between the open and closed positions either manually or through activation of an associated actuation mechanism (not specifically shown). In some embodiments, for instance, the actuation mechanism may comprise a hydraulic actuator configured to act upon the piston 308 and thereby selectively move the piston 308 between the open and closed positions. In other embodiments, however, the actuation mechanism may comprise, but is not limited to, any mechanical actuator, electrical actuator, electromechanical actuator, or pneumatic actuator, without departing from the scope of the disclosure.

The nozzle burner 200 may further include additional seals 318*d* and 318*e* (e.g., O-rings or the like) positioned at one or more interfaces between the piston 308 and corresponding inner surfaces of the internal cavity 310. As the piston 308 moves between the open and closed positions, the seals 318*d,e* may be configured to maintain a fluid seal that prevents migration of air 302*a* past the location of each interface.

As best seen in FIG. 3B, as the piston 308 moves to the closed position, the atomizer 328 is received within the stem conduit 316 of the piston 208. As the atomizer 328 enters the stem conduit 316, one or more seals 318*f* (e.g., O-rings or the like) positioned about the atomizer 328 sealingly engage the inner wall of the stem conduit 316 and thereby prevent the well product 302*b* from migrating past the seal 318*f*, toward the atomizing conduits 332, and into the atomizing chamber 330. The seals 318*c* positioned about the nozzle 204 may also seal against the inner wall of the piston chamber 320. Moreover, as the piston 208 moves to the closed position, the piston 208 (i.e., the walls of the piston chamber 320) progressively occludes and otherwise covers the apertures 334 defined in the nozzle 204, and thereby substantially prevents the air 302*a* from entering the atomizing chamber 330.

The piston 308 may be moved to the closed position until a radial shoulder 340 provided on the piston 308 engages a closure surface 342 provided on the nozzle 204, at which point axial translation of the piston 308 toward the bottom end 205*b* of the outer housing 202 will be stopped. The radial shoulder 340 may be provided at a predetermined distance from the first end 314*a* of the piston body 312, and the atomizer 328 and associated seal 318*f* may each be provided at a predetermined distance from the closure surface 342 such that, as the piston 308 transitions from open to closed, the atomizer 328 enters the stem conduit 316 and the seal 318*f* sealingly engages the inner wall of the stem conduit 316 prior to the radial shoulder 340 engaging the closure surface 342. As a result, the flow of the well product 302*b* toward the atomizing conduits 332 and into the atomizing chamber 330 will be stopped prior to reducing the flow of the air 302*a* into the atomizing chamber 330 via the apertures 334. Similarly, as the piston 308 transitions from closed to open, the flow of the air 302*a* into the atomizing chamber 330 will commence prior to the flow of the well product 302*b*. As will be appreciated, this relationship ensures that no un-atomized well product 302*b* is expelled from the nozzle outlet 210.

Figure 4:
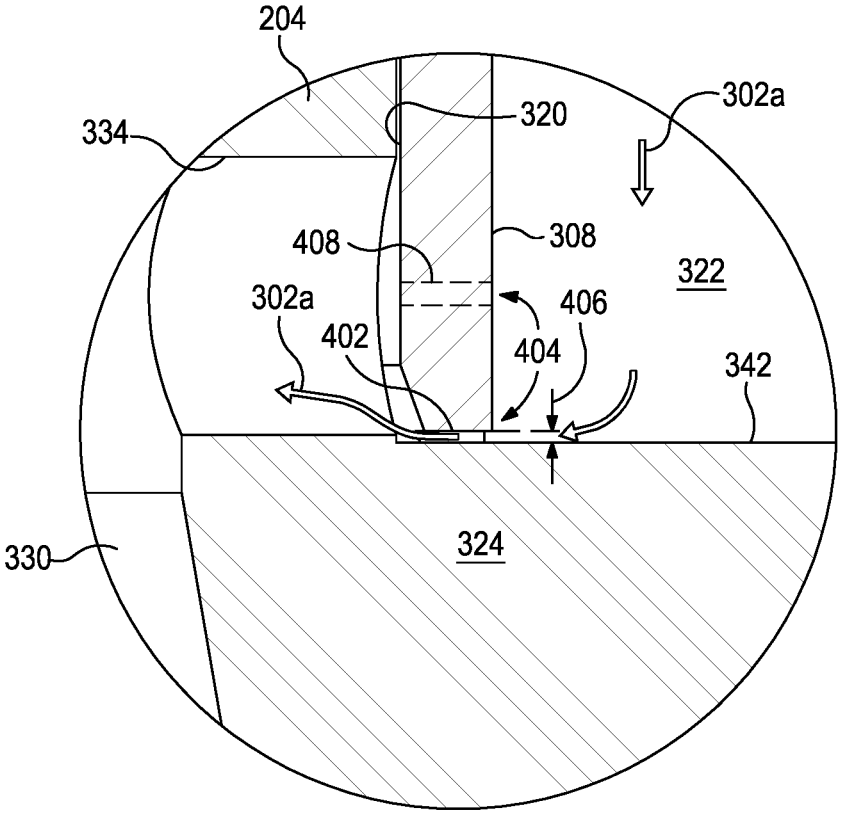
FIG. 4 depicts an enlarged cross-sectional side view of the portion of the burner nozzle indicated in FIG. 3B.

According to one or more embodiments of the present disclosure, a small amount of the air 302*a* may leak into the atomizing chamber 330 via the apertures 334 when the piston 308 is in the closed position, and thereby help to cool the burner nozzle 200 when not operating. More particularly, and with reference now to FIG. 4, and continued reference to FIGS. 3A and 3B, illustrated is an enlarged cross-sectional side view of the portion of the burner nozzle 200 indicated in FIG. 3B. As illustrated, a leading edge 402 may be defined or otherwise provided on the piston 308 at an end of each axial flow port 322. One or more leak paths 404 may be provided at the leading edge 402 to allow a metered amount of air 302*a* to leak into the atomizing chamber 330 via the apertures 334 when the piston 308 is in the closed position. More particularly, the leak path 404 may be defined by a gap 406 provided between the leading edge 402 and the closure surface 342 provided by the nozzle body 324. More particularly, at least a portion of the leading edge 402 may be machined or otherwise shortened as compared to the remaining portions of the radial shoulder 340 (FIGS. 3A and 3B). Accordingly, the leading edge 402 may be selectively shortened at predetermined locations as compared to the radial shoulder 340 at the same axial position to provide the leak path(s) 404.

As a result, when the radial shoulder 340 seats against the closure surface 342, as described above, the air 302*a* is prevented from passing through the interface between the radial shoulder 340 and the closure surface 342. At one or more locations, however, the leading edge 402 may be machined and otherwise configured to provide the gap 406, which may allow a metered amount of the air 302*a* to pass through the wall of the piston 308 from the axial flow port 322, and eventually into the atomizing chamber 330 via the apertures 334. The width or depth of the gap 406 may range between about 0.005 inches and about 0.015 inches, but may alternatively be smaller than 0.005 inches or larger than 0.015 inches, such as between about 0.010 inches and about 0.020 inches deep.

In other embodiments, the one or more leak paths 404 may be provided as one or more flow orifices 408 (one shown) defined through the wall of the piston 308 near the leading edge 402. Similar to the gap 406, the flow orifice(s) 408 may allow a metered amount of air 302*a* to leak into the atomizing chamber 330 via the apertures 334 when the piston 308 is in the closed position.

As the air 302*a* leaks through the leak path(s) 404 and escapes the burner nozzle 200 via the atomizing chamber 330 and the nozzle outlet 210 (FIGS. 3A-3B), it may simultaneously cool the burner nozzle 200 by removing thermal energy. As a result, the adverse effects of radiant thermal energy emitted by adjacent burner nozzles may be mitigated. Moreover, as the air 302*a* leaks through the leak path(s) 404 and escapes the burner nozzle 200 via the atomizing chamber 330, residual well product 302*b* within the atomizing chamber 330 may be atomized and burned, thereby removing the potential for drips. As will be appreciated, this may prove advantageous in improving safety, operational costs, and the environmental impact of the burner nozzle 200.

In some embodiments, various heat transfer structures (not shown) may be positioned at various select locations in the burner nozzle 200 to help increase the heat transfer of the leaking air 302*a*. In one embodiment, for instance, cooling fins (not shown) may be installed or otherwise positioned at the air inlet 206*a*. In other embodiments, or in addition thereto, cooling fins (not shown) may further be positioned within the apertures 334 or the atomizing chamber 330, without departing from the scope of the disclosure.

Figure 5:
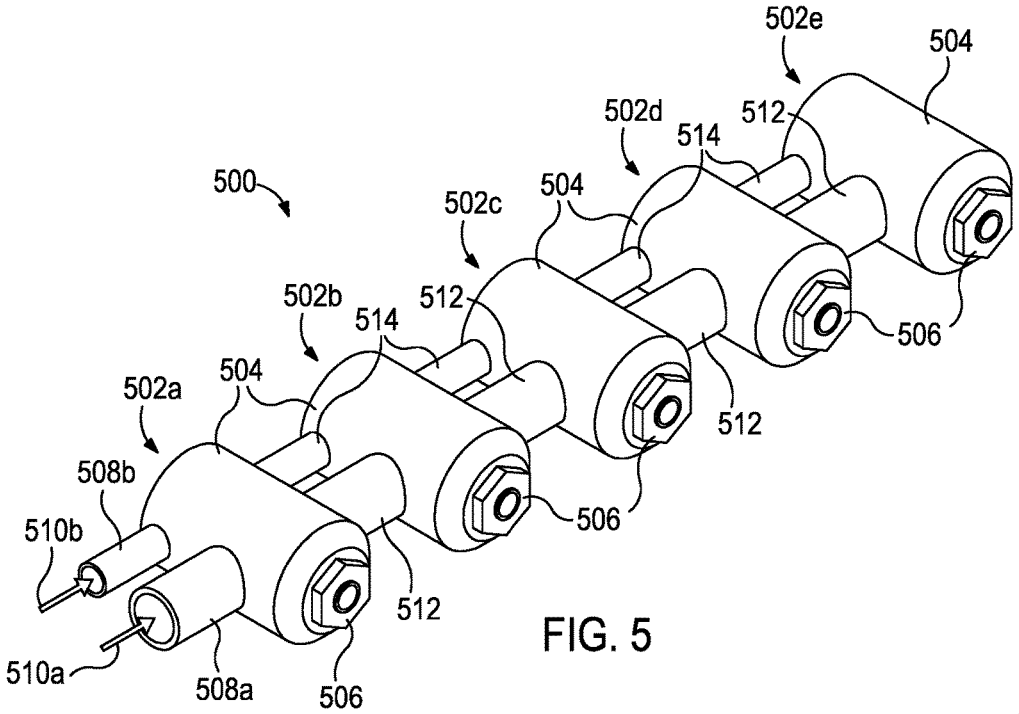
FIG. 5 is an isometric view of an exemplary burner nozzle assembly.

Referring now to FIG. 5, illustrated is an isometric view of an exemplary burner nozzle assembly 500, according to one or more embodiments. As illustrated, the burner nozzle assembly 500 may include a plurality of burner nozzles 502, shown as a first burner nozzle 502*a*, a second burner nozzle 502*b*, a third burner nozzle 502*c*, a fourth burner nozzle 502*d*, and fifth burner nozzle 502*e*. One or more of the burner nozzles 502*a-e* may be the same as or similar to any of the burner nozzles 104 of FIG. 1 and, therefore, may be used in the burner system 100 (FIG. 1) to burn an air/well product mixture. In at least one embodiment, for instance, the burner nozzle assembly 500 may comprise one of the vertical columns of burner nozzles 104 depicted in FIG. 1. Moreover, one or more of the burner nozzles 502*a-e* may be the same as or similar to the burner nozzle 200 of FIGS. 2 and 3A-3B. While five burner nozzles 502*a-e* are depicted in the burner nozzle assembly 500, it will be appreciated that more or less than five burner nozzles 502*a-e* may be employed, without departing from the scope of the disclosure.

As illustrated, each burner nozzle 502*a-e* may include an outer housing 504 and a nozzle 506 received and otherwise secured within the interior of the corresponding outer housing 504. Similar to the outer housing 202 of FIGS. 2 and 3A-3B, the outer housings 504 may each exhibit a generally cylindrical shape. The burner nozzle assembly 500 may include a single air inlet 508*a* that conveys a supply of air 510*a* into each burner nozzle 502*a-e*, and a single well product inlet 508*b* that conveys a supply of a well product 510*b* into each burner nozzle 502*a-e*.

Each burner nozzle 502*a-e* may be fluidly and operatively coupled to an adjacent burner nozzle 502*a-e* via an air transfer conduit 512 and a well product transfer conduit 514. More particularly, at least one air transfer conduit 512 and at least one well product transfer conduit 514 may interpose adjacent pairs of burner nozzles 502*a-e*. Each interposing air transfer conduit 512 may be configured to convey air 510*a* from one burner nozzle 502*a-e* to the next or adjacent burner nozzle 502*a-e*. Similarly, each interposing well product transfer conduit 514 may be configured to convey the well product 510*b* from one burner nozzle 502*a-e* to the next or adjacent burner nozzle 502*a-e*. As a result, the air 510*a* and the well product 510*b* must first pass through the first burner nozzle 502*a* before it can be conveyed to any of the succeeding burner nozzles 502*b-e*. The last burner nozzle 502*e* in the burner nozzle assembly 500 may be capped so that the air 510*a* and the well product 510*b* only exit the burner nozzles 502*a-e* via the nozzles 506.

In some embodiments, the outer housings 504 and the air transfer and well product transfer conduits 512,514 between each outer housing 504 may cooperatively comprise a monolithic component part, such as a manifold. In other embodiments, however, the outer housings 504 and the air transfer and well product transfer conduits 512,514 between each outer housing 504 may each comprise separate parts or structures that may be operatively coupled together to receive the nozzles 506.

Figure 6A:
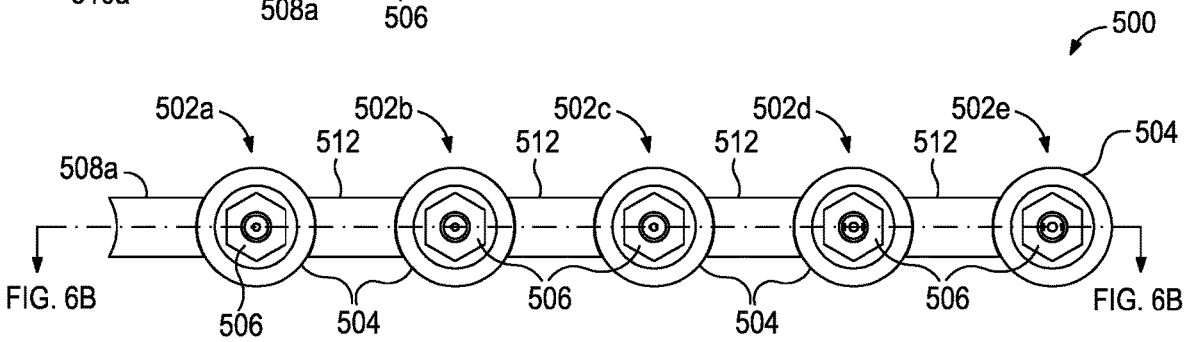
FIGS. 6A and 6B depict end and cross-sectional side views of the burner nozzle assembly of FIG. 5.
Figure 6B:
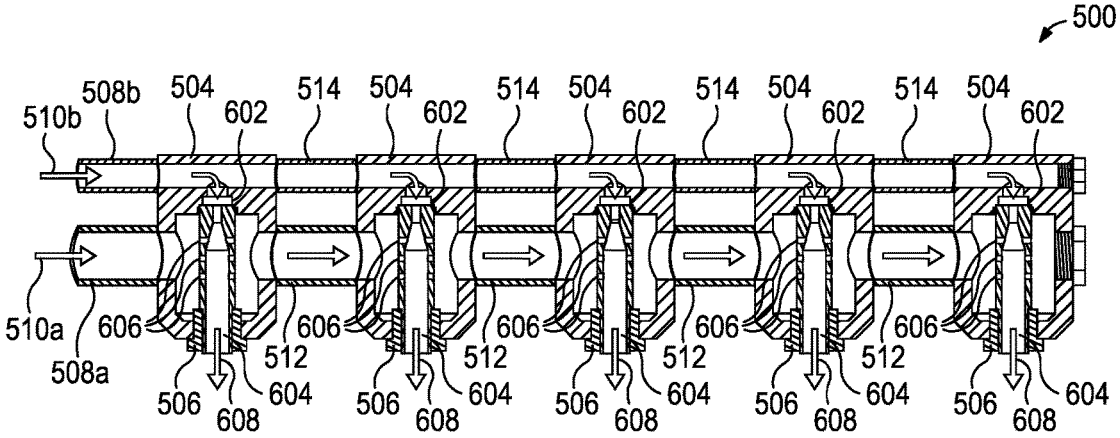

Referring now to FIGS. 6A and 6B, with continued reference to FIG. 5, illustrated are end and cross-sectional side views, respectively, of the burner nozzle assembly 500, according to one or more embodiments. More particularly, FIG. 6A is an end view of the burner nozzle assembly 500 as looking at the end of the nozzles 506, and FIG. 6B is a cross-sectional side view of the burner nozzle assembly 500 as taken along the line indicated in FIG. 6A. The air and well product transfer conduits 512, 514 may each comprise a pipe or tubing conduit either coupled to the outer housing 504 at their respective locations or forming an integral part or extension of the outer housing(s) 504. In some embodiments, one or both of the air and well product transfer conduits 512, 514 may extend into the interior of the adjacent outer housing 504. In other embodiments, however, one or both of the air and well product transfer conduits 512, 514 may be directly or indirectly coupled to the outer surface of the adjacent outer housing 504.

As best seen in FIG. 6B, each burner nozzle 502*a-e* may include an atomizer 602 and an atomizing chamber 604 defined by the corresponding nozzle 506. The atomizer 602 in each burner nozzle 502*a-e* may be configured to convey a portion of the well product 510*b* into the atomizing chamber 604, and one or more apertures 606 defined in each nozzle 506 may be configured to convey a portion of the air 510*a* into the atomizing chamber 604. As a result, a specified or predetermined ratio of air 510*a* and well product 510*b* may be supplied to the atomizing chamber 604 of each burner nozzle 502*a-e* and combined to create an air/well product mixture 608 that may be subsequently discharged from the atomizing chamber 604 via the nozzle 506.

Some or all of the burner nozzles 502*a-e* may be actuatable or otherwise movable between open and closed configurations, as generally described above. In other embodiments, some or all of the burner nozzles 502*a-e* may be moved to the closed configuration by replacing the nozzle 506 with a nozzle plug (not shown). When in the closed configuration, the well product 510*b* may be prevented from entering the atomizing chamber 604 of the corresponding burner nozzle 502*a-e* and mixing with the air 510*a*. Rather, when a particular burner nozzle 502*a-e* is moved to the closed configuration, the well product 510*b* may continue flowing to the next or adjacent burner nozzle 502*a-e* via the adjoining well product transfer conduit 514. As the well product 510*b* flows to subsequent or adjacent burner nozzles 502*a-e*, thermal energy or heat may be drawn away from the closed burner nozzle 502*a-e*, and thereby helping to mitigate the adverse effects of radiant thermal energy emitted from adjacent operating burner nozzles 502*a-e*.

Moreover, when a particular burner nozzle 502*a-e* is moved to the closed configuration, the air 510*a* may flow around the nozzle 506 within the outer housing 504 and continue flowing to the next or adjacent burner nozzle 502*a-e* via the adjoining air transfer conduit 512. As the air 510*a* flows to subsequent or adjacent burner nozzles 502*a-e*, thermal energy or heat may be drawn away from the closed burner nozzle 502*a-e*, and thereby helping to mitigate the adverse effects of radiant thermal energy emitted from adjacent operating burner nozzles 502*a-e*. In some embodiments, at least a portion of the air 510*a* may flow into the atomizing chamber 604 and may escape the particular burner nozzle 502*a-e* via the nozzle 504 or, more particularly, via a specially designed nozzle plug (not shown). In such embodiments, the air 510*a* may not only flow around the nozzle 506 within the outer housing 504 and continue flowing to the next or adjacent burner nozzle 502*a-e*, but may also escape the nozzle 506 and thereby draw thermal energy away from the particular burner nozzle 502*a-e*.

Figure 7B:
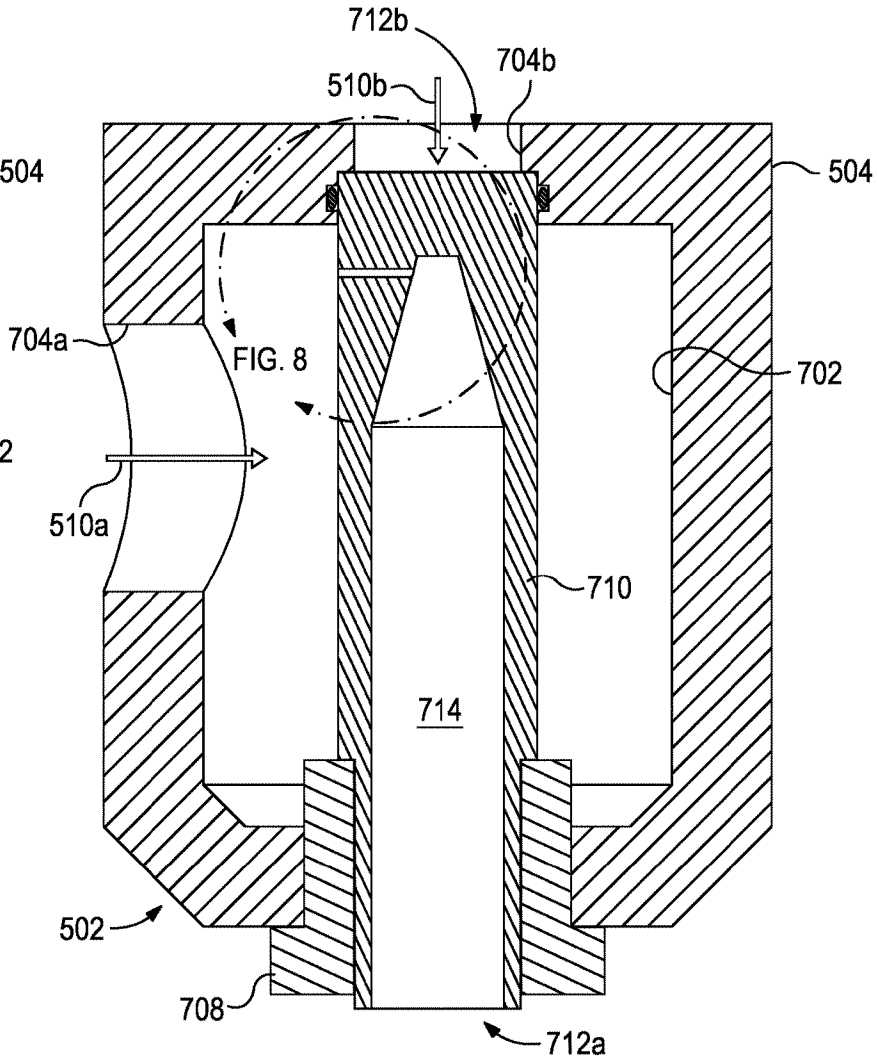
FIGS. 7A and 7B are cross-sectional side views of an exemplary burner nozzle in an open configuration and a closed configuration, respectively.
Figure 7A:
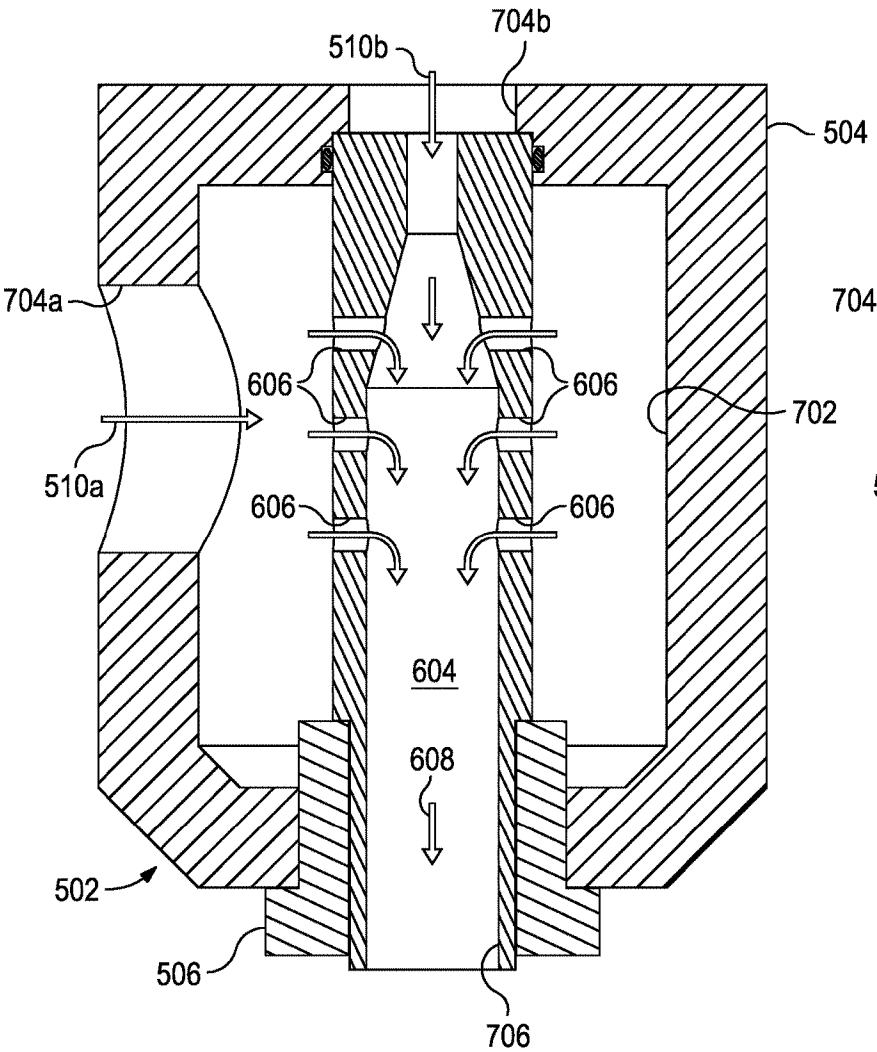

Referring now to FIGS. 7A and 7B, with continued reference to FIGS. 5 and 6A-6B, illustrated are cross-sectional side views of an exemplary burner nozzle 502 in an open configuration and a closed configuration, respectively, according to one or more embodiments. As illustrated in FIG. 7A, the burner nozzle 502 includes the outer housing 504 and the nozzle 506 received and otherwise secured within an interior 702 of the outer housing 504. A supply of air 510*a* may be conveyed into the interior 702 via an air inlet 704*a*, and a supply of the well product 510*b* may be conveyed to the atomizer 602 via a well product inlet 704*b*. The air 510*a* may enter the atomizing chamber 604 via the apertures 606 and mix with the well product 510*b* to generate the air/well product mixture 608 that is discharged from the burner nozzle via a nozzle outlet 706.

As will be appreciated, the burner nozzle 502 is depicted in FIG. 7A in the open configuration. In some embodiments, as shown in FIG. 7B, when it is desired to move the burner nozzle 502 to the closed configuration, the nozzle 506 may be removed and replaced with a nozzle plug 708 that may be inserted into and otherwise secured within the interior 702 of the outer housing 504. The nozzle plug 708 may provide a generally cylindrical body 710 having an open end 712*a*, a closed end 712*b*, and an inner chamber 714 defined between the open and closed ends 712*a,b*. As illustrated, the closed end 712*b* may close off and otherwise plug the well product inlet 704*b* such that the well product 510 is prevented from entering the interior 702 of the outer housing 504. Moreover, the body 710 does not include the apertures 606 (FIG. 7A) and, therefore, the air 510*a* is substantially prevented from entering the inner chamber 714.

Figure 8:
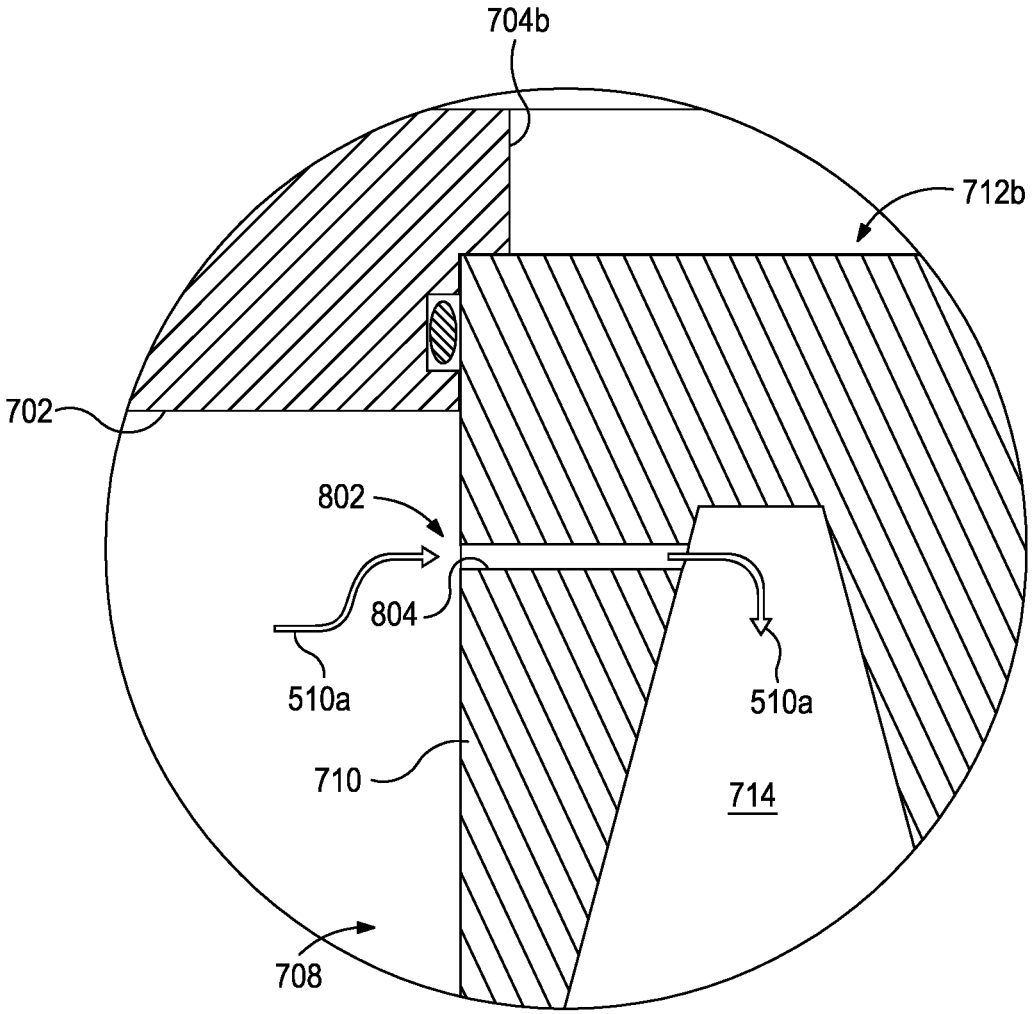
FIG. 8 is an enlarged cross-sectional side view of the portion of the burner nozzle indicated in FIG. 7B.

According to one or more embodiments of the present disclosure, however, a small amount of the air 510*a* may leak into the inner chamber 714 when the burner nozzle 502 is moved to the closed configuration, and thereby help to cool the burner nozzle 502 when not operating. More particularly, and with reference to FIG. 8, and continued reference to FIG. 7B, illustrated is an enlarged cross-sectional side view of the portion of the burner nozzle 502 indicated in FIG. 7B. As illustrated, one or more leak paths 802 (one shown) may be defined in the nozzle plug 708 to allow a metered amount of air 510*a* to leak into the inner chamber 714 when the burner nozzle 502 is moved to the closed configuration. More particularly, the leak path 802 may comprise one or more flow orifices 804 (one shown) defined through the body 710 of the nozzle plug 708. The flow orifice(s) 804 may allow a metered amount of air 51 to leak into the inner chamber 714 and escape the burner nozzle 502 at the open end 712*a* of the body 710.

As the air 510*a* leaks through the leak path(s) 802 and escapes the burner nozzle 502 via the open end 712*a* of the body 710, it may simultaneously cool the burner nozzle 502 by removing thermal energy. As a result, the adverse effects of radiant thermal energy emitted by adjacent burner nozzles may be mitigated. As will be appreciated, this may prove advantageous in improving safety, operational costs, and the environmental impact of the burner nozzle 200. In some embodiments, various heat transfer structures (not shown) may be positioned at various select locations in the burner nozzle 502 to help increase the heat transfer of the leaking air 510*a*. In one embodiment, for instance, cooling fins (not shown) may be installed or otherwise positioned at the air inlet 704*a*.

Embodiments disclosed herein include:

A. A burner nozzle that includes an outer housing that defines an internal cavity, a nozzle receivable within the internal cavity and defining an atomizing chamber, and a piston receivable within the internal cavity and providing a piston body that defines a piston chamber that receives at least a portion of the nozzle, wherein the piston is axially movable within the internal cavity between an open position, where air and a well product provided to the outer housing enter the atomizing chamber to generate an air/well product mixture, and a closed position, where the piston moves to stop a flow of the well product and a metered amount of air flows through one or more leak paths and into the atomizing chamber, the one or more leak paths being defined near a leading edge of the piston.

B. A method that includes conveying air and a well product to a burner nozzle, the burner nozzle including an outer housing that defines an internal cavity, a nozzle receivable within the internal cavity and defining an atomizing chamber, and a piston receivable within the internal cavity and providing a piston body that defines a piston chamber that receives at least a portion of the nozzle, receiving the air and the well product into the atomizing chamber and thereby generating an air/well product mixture, moving the piston axially within the internal cavity to a closed position, where a flow of the well product into the atomizing chamber stops and one or more leak paths are defined near a leading edge of the piston, allowing a metered amount of air to flow through the one or more leak paths and into the atomizing chamber, and cooling the burner nozzle as the metered amount of air escapes the burner nozzle via a nozzle outlet.

C. A burner nozzle assembly that includes a plurality of burner nozzles, each burner nozzle including an outer housing and a nozzle received within an interior of the outer housing, an air inlet that conveys air into a first burner nozzle of the plurality of burner nozzles, a well product inlet that conveys a well product into the first burner nozzle of the plurality of burner nozzles, an air transfer conduit interposing and fluidly coupling the outer housing of adjacent burner nozzles such that the air is transferred from the first burner nozzle to all subsequent burner nozzles, and a well product transfer conduit interposing and fluidly coupling the outer housing of adjacent burner nozzles such that the well product is transferred from the first burner nozzle to all subsequent burner nozzles.

D. A method that includes providing a burner nozzle assembly that includes a plurality of burner nozzles, each burner nozzle including an outer housing and a nozzle received within an interior of the outer housing, supplying air into a first burner nozzle of the plurality of burner nozzles via an air inlet, supplying a well product into the first burner nozzle of the plurality of burner nozzles via a well product inlet, transferring the air from the first burner nozzle to all subsequent burner nozzles via one or more air transfer conduits interposing and fluidly coupling the outer housing of adjacent burner nozzles, and transferring the well product from the first burner nozzle to all subsequent burner nozzles via one or more well product transfer conduits interposing and fluidly coupling the outer housing of adjacent burner nozzles.

Each of embodiments A, B, C, and D may have one or more of the following additional elements in any combination: Element 1: wherein the nozzle provides a nozzle body and an atomizer extending from the nozzle body, the nozzle body defining a nozzle outlet and the atomizing chamber extending between the nozzle outlet and the atomizer, and wherein the piston provides a piston body that has a first end, a second end, and a stem conduit extending from the first end and into a well product inlet. Element 2: further comprising one or more axial flow ports defined in the piston body and extending between the first end and the piston chamber, each axial flow port being fluidly coupled to the air inlet to provide air to the piston chamber, and one or more apertures defined in the nozzle body to provide fluid communication between the atomizing chamber and the air inlet via the piston chamber. Element 3: further comprising one or more atomizing conduits defined in the nozzle body at the atomizer to provide fluid communication between the atomizing chamber and the well product inlet, wherein the one or more atomizing conduits and the one or more apertures each exhibit a predetermined flow area to meter a known amount of well product and air, respectively, into the atomizing chamber. Element 4: wherein, as the piston moves to the closed position, a wall of the piston chamber progressively occludes the one or more apertures. Element 5: further comprising at least one seal disposed about the atomizer, wherein, when the piston is moved to the closed position, the atomizer is received within the stem conduit and the at least one seal sealingly engages an inner wall of the stem conduit. Element 6: further comprising a radial shoulder provided by the piston to seat against a closure surface provided by the nozzle when the piston is in the closed position, wherein at least a portion of the leading edge is shortened as compared to the radial shoulder to define a gap that forms the one or more leak paths. Element 7: wherein the one or more leak paths comprise one or more flow orifices defined through a wall of the piston near the leading edge.

Element 8: wherein the nozzle includes a nozzle body and an atomizer extending from the nozzle body, the atomizing chamber extending between the nozzle outlet and the atomizer, and wherein the piston includes a piston body that has a first end, a second end, and a stem conduit extending from the first end, the method further comprising conveying the well product into the atomizing chamber via one or more atomizing conduits defined in the nozzle body at the atomizer. Element 9: wherein the burner nozzle further includes one or more axial flow ports defined in the piston body and extending between the first end and the piston chamber, and one or more apertures defined in the nozzle body to provide fluid communication between the atomizing chamber and the piston chamber, and wherein the one or more atomizing conduits and the one or more apertures each exhibit a predetermined flow area, the method further comprising metering a known amount of well product and air into the atomizing chamber via the one or more atomizing conduits and the one or more apertures, respectively. Element 10: further comprising receiving the atomizer within the stem conduit when the piston is moved to the closed position, and sealingly engaging an inner wall of the stem conduit with at least one seal disposed about the atomizer. Element 11: wherein moving the piston axially within the internal cavity to the closed position further comprises seating a radial shoulder provided by the piston against an adjacent closure surface provided by the nozzle body, wherein at least a portion of the leading edge of each axial flow port is shortened as compared to the radial shoulder to define a gap that forms the one or more leak paths. Element 12: wherein allowing the metered amount of air to flow through the one or more leak paths and into the atomizing chamber comprises allowing the metered amount of air to flow through one or more flow orifices defined through a wall of the piston near the leading edge. Element 12: further comprising progressively occluding the one or more apertures with a wall of the piston chamber as the piston moves to the closed position. Element 13: further comprising atomizing and burning residual well product within the atomizing chamber as the metered amount of air flows through the one or more leak paths.

Element 14: wherein the outer housing of each burner nozzle, each air transfer conduit, and each well product transfer conduit cooperatively comprise a monolithic component part. Element 15: wherein each burner nozzle comprises an atomizer in fluid communication with the well product inlet, one or more apertures defined in the nozzle, and an atomizing chamber defined by the nozzle to receive a portion of the well product from the atomizer and a portion of the air via the one or more apertures to create an air/well product mixture. Element 16: wherein at least one of the burner nozzles is movable between an open configuration, where the portion of the air and the portion of the well product enter the atomizing chamber to generate the air/well product mixture, and a closed configuration, where a flow of the well product into the atomizing chamber ceases but continues to a subsequent burner nozzle. Element 17: wherein, when the at least one of the burner nozzles is moved to the closed configuration, a flow of the air into the atomizing chamber and to the subsequent burner nozzle continues. Element 18: further comprising a nozzle plug that replaces the nozzle within the outer housing to move a corresponding burner nozzle from an open configuration to a closed configuration, the nozzle plug including a body having an open end, a closed end, and an inner chamber defined between the open and closed ends, wherein the closed end prevents the well product from entering the interior of the outer housing, and one or more leak paths defined in the nozzle plug to allow a metered amount of air to leak into the inner chamber and escape the body at the open end. Element 19: wherein the one or more leak paths comprise one or more flow orifices defined through the body of the nozzle plug.

Element 20: wherein each burner nozzle comprises an atomizer in fluid communication with the well product inlet and one or more apertures defined in the nozzle, the method further comprising receiving a portion of the well product from the atomizer in an atomizing chamber defined by the nozzle, and receiving a portion of the air in the atomizer via the one or more apertures and thereby creating an air/well product mixture. Element 21: further comprising moving at least one of the burner nozzles to a closed configuration and thereby ceasing a flow of the well product into the atomizing chamber, conveying the flow of the well product to a subsequent burner nozzle, and drawing thermal energy away from the at least one of the burner nozzles with the flow the well product to the subsequent burner nozzle. Element 22: further comprising continuing a flow of the air into the atomizing chamber and to the subsequent burner nozzle when the at least one of the burner nozzles is moved to the closed configuration, and drawing thermal energy away from the at least one of the burner nozzles with the flow the air to the subsequent burner nozzle. Element 23: wherein moving the at least one of the burner nozzles to the closed configuration comprises replacing the nozzle with a nozzle plug within the outer housing, the nozzle plug including a body having an open end, a closed end, and an inner chamber defined between the open and closed ends, preventing the well product from entering the interior of the outer housing with the closed end, and allowing a metered amount of air to leak into the inner chamber via one or more leak paths defined in the nozzle plug. Element 24: wherein the one or more leak paths comprise one or more flow orifices defined through the body of the nozzle plug, the method further comprising allowing the metered amount of air to leak into the inner chamber via the one or more flow orifices, and cooling the at least one of the burner nozzles as the air escapes the body at the open end. Element 25: further comprising atomizing and burning residual well product within the inner chamber as the metered amount of air flows through the one or more leak paths.

By way of non-limiting example, exemplary combinations applicable to A, B, C, and D include: Element 1 with Element 2; Element 2 with Element 3; Element 2 with Element 4; Element 1 with Element 5; Element 15 with Element 15; Element 15 with Element 17; Element 17 with Element 18; Element 18 with Element 19; Element 20 with Element 21; Element 21 with Element 22; Element 22 with Element 23; Element 23 with Element 24; and Element 23 with Element 25.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The invention claimed is:

1. A burner nozzle assembly, comprising:

a plurality of burner nozzles, each burner nozzle including an outer housing and a nozzle received within an interior of the outer housing;

an air inlet that conveys air into a first burner nozzle of the plurality of burner nozzles;

a well product inlet that conveys a well product into the first burner nozzle of the plurality of burner nozzles;

an air transfer conduit interposing and fluidly coupling the outer housing of adjacent burner nozzles that transfers the air from the first burner nozzle to all subsequent burner nozzles; and a well product transfer conduit interposing and fluidly coupling the outer housing of adjacent burner nozzles that transfers the well product from the first burner nozzle to all subsequent burner nozzles.

2. The burner nozzle assembly of claim 1, wherein the outer housing of each burner nozzle, the air transfer conduit, and the well product transfer conduit cooperatively comprise a monolithic component part.

3. The burner nozzle assembly of claim 1, further comprising cooling fins positioned at the air inlet.

4. The burner nozzle assembly of claim 1, wherein each burner nozzle comprises:

an atomizer in fluid communication with the well product inlet;

one or more apertures defined in the nozzle; and an atomizing chamber defined by the nozzle to receive a portion of the well product from the atomizer and a portion of the air via the one or more apertures to create an air/well product mixture.

5. The burner nozzle assembly of claim 4, wherein at least one burner nozzle of the plurality of burner nozzles is movable between an open configuration that allows the portion of the air and the portion of the well product to enter the atomizing chamber to generate the air/well product mixture, and a closed configuration that ceases flow of the well product into the atomizing chamber while allowing flow of the well product to continue to a subsequent burner nozzle.

6. The burner nozzle assembly of claim 4, wherein the atomizing chamber comprises an outlet, wherein the air/well product mixture is expelled from the atomizing chamber through the outlet to be burned.

7. The burner nozzle assembly of claim 4, further comprising at least one pilot burner, wherein the at least one pilot burner generates a pilot flame which burns the air/well product mixture as it is expelled from at least one burner nozzle of the plurality of burner nozzles.

8. The burner nozzle assembly of claim 4, wherein at least one burner nozzle of the plurality of burner nozzles comprises cooling fins positioned within the atomizing chamber.

9. The burner nozzle assembly of claim 5, wherein the at least one burner nozzle comprises a piston received within the interior of the outer housing, wherein axial movement of the piston within the interior of the outer housing moves the at least one burner nozzle between the open configuration and the closed configuration.

10. The burner nozzle assembly of claim 6, wherein a first burner nozzle of the plurality of burner nozzles is positioned adjacent to a second burner nozzle of the plurality of burner nozzles, wherein the first and second burner nozzles are positioned to allow the air/well product mixture expelled from the first burner nozzle to overlap with the air/well product mixture expelled from the second burner nozzle.

11. A method comprising:

conveying air and a well product to a first burner nozzle of a plurality of burner nozzles, wherein each burner nozzle of the plurality of burner nozzles comprises an outer housing that defines an internal cavity, a nozzle that is receivable within the internal cavity and that defines an atomizing chamber, and one or more apertures defined in the nozzle;

conveying a portion of the air, via an air transfer conduit, and a portion of the well product, via a well product transfer conduit, from the first burner nozzle to a second burner nozzle of the plurality of burner nozzles, wherein the air transfer conduit and the well product transfer conduit interpose and fluidly couple the outer housing of the first burner nozzle with the outer housing of the second burner nozzle;

moving the first burner nozzle to a closed configuration which blocks a flow of the well product into the atomizing chamber of the first burner nozzle; and flowing air through the first burner nozzle to cool the first burner nozzle.

12. The method of claim 11, wherein flowing air through the first burner nozzle comprises flowing air around the nozzle within the outer housing of the first burner nozzle, wherein air flowed around the nozzle within the outer housing of the first burner nozzle continues to flow through the air transfer conduit to the second burner nozzle.

13. The method of claim 11, wherein flowing air through the first burner nozzle comprises flowing a metered amount of air through the one or more apertures and into the atomizing chamber of the first burner nozzle.

14. The method of claim 11, further comprising moving the first burner nozzle to an open configuration which allows a flow of the air and the flow of the well product into the atomizing chamber of the first burner nozzle to generate an air/well product mixture.

15. The method of claim 11, wherein the first burner nozzle comprises a piston received within the internal cavity of the outer housing of the first burner nozzle, wherein moving the first burner nozzle to the closed configuration comprises axially moving the piston within the internal cavity which blocks the flow of the well product into the atomizing chamber of the first burner nozzle.

16. The method of claim 14, further comprising expelling, from the atomizing chamber of the first burner nozzle, the air/well product mixture.

17. The method of claim 16, further comprising igniting the air/well product mixture.

18. A burner nozzle assembly, comprising:

a plurality of burner nozzles;

an air transfer conduit interposing and fluidly coupling an outer housing of a first burner nozzle of the plurality of burner nozzles with a second burner nozzle of the plurality of burner nozzles, wherein air flows from the first burner nozzle to the second burner nozzle through the air transfer conduit; and a well product transfer conduit interposing and fluidly coupling the outer housing of the first burner nozzle with the second burner nozzle, wherein well product flows from the first burner nozzle to the second burner nozzle through the well product transfer conduit.

19. The burner nozzle assembly of claim 18, further comprising:

an air inlet that conveys air into the first burner nozzle; and a well product inlet that conveys the well product into the first burner nozzle.

20. The burner nozzle assembly of claim 18, wherein at least one burner nozzle of the plurality of burner nozzles is movable between an open configuration, where a portion of the air and a portion of the well product enter an atomizing chamber of the at least one burner nozzle to generate an air/well product mixture, and a closed configuration, where a flow of the well product into the atomizing chamber ceases.

* * * * *